US006457846B2

(12) United States Patent
Cook et al.

(10) Patent No.: US 6,457,846 B2
(45) Date of Patent: Oct. 1, 2002

(54) LAMP ASSEMBLY

(75) Inventors: Mike Cook, Wilts; Patrick Gerard Keogh, Berkshire, both of (GB)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 09/800,942

(22) Filed: Mar. 7, 2001

(30) Foreign Application Priority Data

Mar. 8, 2000 (GB) ..... 0005598

(51) Int. Cl.[7] ..... F21V 17/02

(52) U.S. Cl. ..... 362/321; 362/217; 362/319; 362/346; 356/322

(58) Field of Search ..... 362/217, 218, 362/319, 321, 345, 346; 356/322

(56) References Cited

U.S. PATENT DOCUMENTS 4,596,935 A 6/1986 Lumpp ..... 250/495.1
5,515,169 A * 5/1996 Cargill ..... 356/417
5,722,761 A * 3/1998 Knight ..... 362/96

FOREIGN PATENT DOCUMENTS

| | | |
|---|---|---|
| EP | 0219255 | 4/1987 |
| GB | 1554253 | 10/1979 |
| GB | 2284469 | 6/1995 |
| GB | 2336895 | 11/1999 |
| JP | 020253840 | 10/1990 |

* cited by examiner

*Primary Examiner*—Sandra O'Shea
*Assistant Examiner*—Ali Alavi
(74) *Attorney, Agent, or Firm*—Wood, Herron & Evans, L.L.P.

(57) ABSTRACT

A lamp assembly for use in the printing and coating industries has an elongate source of radiation and a reflector with an elongate reflective surface partly surrounding the source for reflecting radiation from the source down onto a substrate for curing a coating thereon. A shutter system is provided for shuttering the source to prevent radiation from reaching the substrate. The condition of the lamp assembly is monitored by shuttering the source and measuring the level of reflected radiation exiting through an aperture in the reflector.

13 Claims, 6 Drawing Sheets

LAMP ASSEMBLY

This application claims the priority of British Patent Application No. 0005598.8 filed Mar. 8, 2000, the disclosure of which is hereby fully incorporated by reference herein.

FIELD OF THE INVENTION

This invention relates to lamp assemblies, and more particularly to lamp assemblies for use in the printing and coating industry for the fast curing of inks and the like on a large variety of substrate materials.

BACKGROUND OF THE INVENTION

During the curing process, the substrate is moved in a path beneath an elongate lamp assembly so that a coating on the substrate is irradiated by radiation from the lamp to cure the coating in a continuous process. The substrate may be continuous or comprise multiple sheets which are fed past the lamp in succession.

It is well known to cure inks on a substrate by application of ultra-violet radiation from one or more medium-pressure ultra-violet lamps. It is also well known to provide each lamp in an assembly with a reflector which includes a reflective surface partly surrounding the lamp for reflecting radiation therefrom onto the substrate. The reflective surface has a concave profile which is commonly elliptical or parabolic, the lamp being mounted on the symmetrical centre line of the profile and adjacent the apex.

The reflector increases the intensity of the radiation received by the curable material. The penetration of the radiation into the material is an important factor in curing and, while penetration varies with different colors and materials, the higher the intensity the better the penetration.

A problem which arises with known arrangements is that part of the radiation is reflected back onto the lamp itself. This reduces the amount of radiation energy available for curing and leads to heating of the lamp which can adversely affect lamp operation and increase the already large amount of heat given off by the assembly. The increased heat may cause warping and distortion of the coating and/or the substrate.

This problem has been recognized in French Patent 2334966 which describes a reflector in the form of two half-shells, each of which is pivotal about a longitudinal axis within the cavity to the sides of the symmetrical center line thereof. The French Patent proposes deforming the top region of the reflector to give it, externally, a generally concave shape across the width of the lamp by bending the top edge of each half-shell down towards the lamp.

The apparatus disclosed in French Patent 2334966 has disadvantages as a result of its basic form in that a complicated system will be necessary to achieve the desired pivoting action and space has to be provided to accommodate pivoting of the half-shell. The increased space is inconsistent with the current industry desire for smaller curing assemblies. Cooling of the half-shells will be difficult, again because of the need to accommodate the pivoting action. Problems will also arise as a result of the solution proposed in the French Patent to the problem of lamp self-heating. The distortion of the reflector towards the lamp will lead to excessive heating of the distorted portion and will make cooling of the adjacent region of the lamp much more difficult.

The desire in the industry for smaller curing assemblies mentioned above gives rise to problems with shuttered reflectors in which two shutters are pivotally mounted below the reflector such that their lower ends can be swung together to prevent passage of radiation from the source to the substrate. Decreasing the size of the lamp assembly can bring the shutters too close to the lamp itself and cause overheating of the shutters. It has been proposed to provide a movable lamp but this obviously increases the complexity of the overall lamp assembly and makes cooling of the lamp more difficult.

The efficient and effective cooling of lamp assemblies has been a constant problem which has become even more important as ever increasing lamp powers have been employed to give faster curing such that substrate speeds can be increased. For example, at the date of the French Patent, 1975, lamp powers were only in the region of 250 Watts per inch (100 Watts per cm). Lamp powers of 200–400 Watts per inch (80–160 Watts per cm) are now common and lamps of even higher powers, 500–600 Watts per inch (200–240 Watts per cm) are increasingly being used. Furthermore, the advantages of UV curing, including cleanness and quality, have led to a demand for curing systems capable of operating with a wide variety of substrates, including substrates which are very vulnerable to heat damage.

Earlier assemblies were generally cooled by air alone. In the first air-cooled systems, air was extracted from within the reflector through one or more openings provided above the lamp to draw out the heat. In later systems, cooling air was blown into the assembly and onto the lamp, again through openings located adjacent the lamp. A problem with air cooling is that the blowers required increase the size of the assembly making it difficult to install between the stands of a multi-stand press.

This, and the increasing cooling requirements due to higher lamp powers, led to the use of water cooling alone or in conjunction with air cooling. The cooling water is fed through tubes attached to or integrally formed in the reflector. In addition, a number of designs have been proposed with filters comprising one or two tubes of quartz provided between the lamp and the substrate through which liquid is passed, typically distilled de-ionised water. As well as contributing to the cooling, the filters have the primary effect of filtering infra-red radiation, which tends to heat the substrate, and focusing the light from the lamp onto the substrate. The liquid coolant is circulated to and from all the tubes through cooling or refrigerating means.

As lamp powers increase, ever more efficient and effective cooling systems are required to keep temperatures within acceptable limits, not only to prevent damage to the substrate, but also to prevent harm to adjacent equipment and to operators of the printing system.

One known lamp assembly has a reflector in the form of a block with a cavity. The reflective surface is provided on the surface of the cavity. The reflective surface may be formed by polishing the cavity surface or a specific reflector member can be attached thereto. In either case it is known to provide coatings on the reflective surface of heat-absorbing material. To allow air cooling when a separate reflector member is employed, it is necessary to punch one or more holes through the member to provide a connection to the air flow passage or passages. With an integral reflector on the other hand, damage to the reflective surface requires replacement of the block with consequent disconnection and reconnection to the cooling fluid supplies.

When UV lamps were first developed for curing purposes, the UV output was monitored by measuring the drawn current of the lamp. However, this does not give an accurate measurement since many other factors can affect UV production. In recent years UV monitors have been included in lamp assemblies but their positioning is problematic. If the monitor is positioned above the lamp, as is often the case, it does not provide an accurate reading of the reflected UV which is required in order to properly assess the curing capability of the lamp assembly.

It is a general object of the present invention to provide a lamp assembly which overcomes one or more of the problems associated with known assemblies, as discussed above.

SUMMARY OF THE INVENTION

The invention provides a method of monitoring the condition of a lamp assembly comprising an elongate source of radiation, a reflector with an elongate reflective surface partly surrounding the source for reflecting radiation from the source down onto a substrate for curing a coating thereon and a shutter system for shuttering the source to prevent radiation reaching the substrate, the method comprising shuttering the source and measuring the level of reflected radiation exiting via an aperture through the reflector.

It has been found that by measuring the reflected radiation exiting via an aperture through the reflector, it is possible to accurately monitor the condition of both the source and the reflector. Changes in condition of either such as reduction in lamp output or dulling of any part of the reflector affects the level of reflected radiation. No prior internal method has allowed proper monitoring of the condition of the whole lamp assembly.

The measurement is most suitably made using a UV monitor located above the source and to one side thereof. The position of the monitor means that it will not interfere with elements below the lamp, particularly substrate feeding systems.

A lamp assembly for carrying out the method comprises an elongate source of radiation, a reflector with an elongate reflective surface partly surrounding the source for reflecting radiation from the source down onto a substrate for curing a coating thereon, a shutter system for shuttering the source to prevent radiation from reaching the substrate, and a monitor for measuring the level of reflected radiation exiting via an aperture through the reflector.

The reflector may comprise at least three spaced elements, including one upper element above the radiation source and two side elements, one on either side of the radiation source.

Formation of the reflector with at least three elements enables the cross-section of the reflective surface to be generally rectangular which is more economical in terms of overall size than the known elliptical or parabolic reflective surfaces. Furthermore, it has been found possible to arrange the reflector such that it is significantly more efficient in terms of UV output than comparatively sized known reflectors having an elliptical or a parabolic reflective surface.

Preferably, the side elements are adjustable to vary the cross-section of the reflective surface and the spacing between the lower ends of the side elements. It has been found that by making the side elements adjustable and preferably rotatable, it is possible to vary the intensity of the UV output of the radiation source. In addition, it is possible to vary the ratio of UV to infrared radiation which reaches the substrate and increase this in comparison with known lamp assemblies.

The shutter system for shuttering the source to prevent radiation reaching the substrate may comprise two elements positioned on either side of the source.

The side elements of the shutter preferably form part of the reflector. By including the shutters as part of the reflector, the problems found with known arrangements where the shutters were separate are obviated and the lamp assembly size can be reduced without risking damage to the shutters or the source.

With the preferred embodiment in which the shutter elements also form part of the reflector, the method preferably further comprises measuring the level of radiation reflected from one of the elements. Correspondingly in a particular preferred embodiment of the lamp assembly, this includes a UV monitor for monitoring the UV light reflected from one of the side elements via an aperture in the reflector.

Preferably, the reflector includes an opening therein above the source and extraction means for drawing air from above the substrate upwardly and over the lamp and through the reflector opening, and when the source is shuttered, the air is drawn up to the outer sides of the side elements and passes there above to the source.

By extracting the air upwards, it is caused to swirl and eddy around nearly the complete lamp circumference when, as is often the case, the source is in the form of a tubular lamp. This gives good cooling efficiency and, therefore, lamp efficiency and also prolongs lamp life.

The shutter arrangement has the effect of reducing the cooling of the source when it is closed. With prior art arrangements where the source is cooled from above, cooling is constant including during stand-by mode. As a result, the stand-by power level of the source has to be sufficiently high to prevent any risk of the source dying. Diverting the air flow by use of the shutters allows the stand-by power level to be reduced. However, sufficient air is still provided to remove the ozone which is formed by the source.

The reflector elements may each comprise a body with optional passages for flow of cooling fluid and a reflective sheet attached to the body, the reflective sheet comprising a coated substrate. The coating may be a dichroic coating. The advantage of using a dichroic coating is that this reflects UV but absorbs infrared and so reduces the level of IR reaching the substrate.

The coated substrate may be attached to the body by one or more releasable clips which makes replacement of the reflective sheets a simple operation.

The side elements may have a straight of only minorily curved reflective surface and the reflector overall is preferably arranged such that there is no internal reflection of radiation off the reflective surface. These two features together give the desired high intensity UV output.

BRIEF DESCRIPTION OF THE DRAWINGS

The invention will now be further described by way of example with reference to the accompany drawings in which.

DETAILED DESCRIPTION OF THE PREFERRED EMBODIMENTS

Figure 1A:
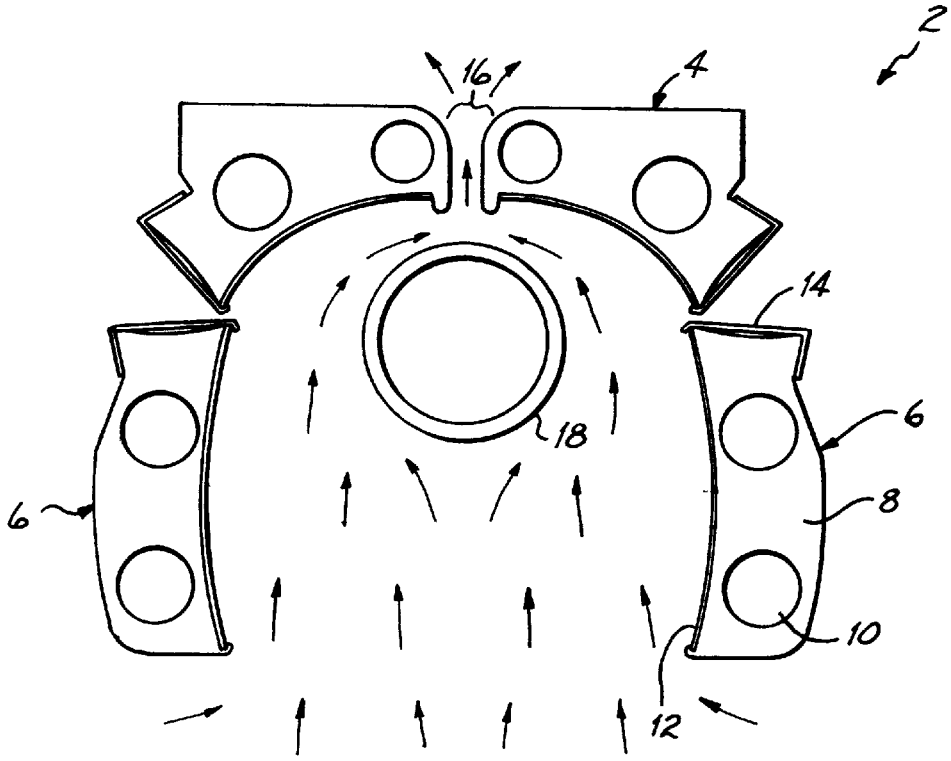
FIGS. 1A and 1B are schematic views of a lamp assembly in accordance with the invention showing the shutters in the open and closed positions.

The lamp assembly 2 comprises a reflector formed from two top elements 4 and two side elements 6. Each element 4, 6 comprises a block 8 formed with passages 10 for passage of cooling fluid. A reflective sheet 12 is attached to the block 8 by a releasable clip 14. Each reflective sheet 12 comprises a substrate with a reflective coating, preferably a dichroic coating.

Figure 1B:
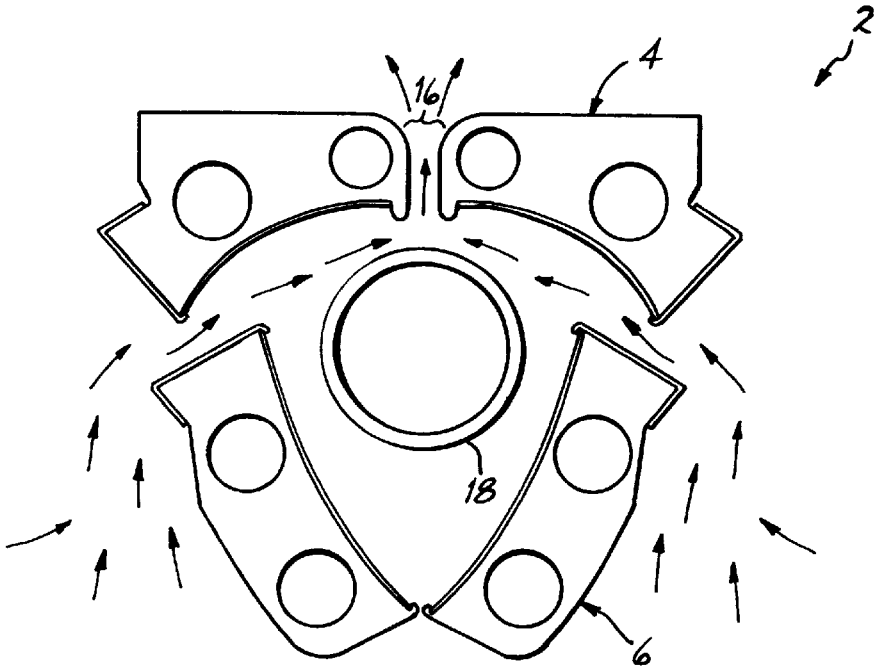
Figure 2A:
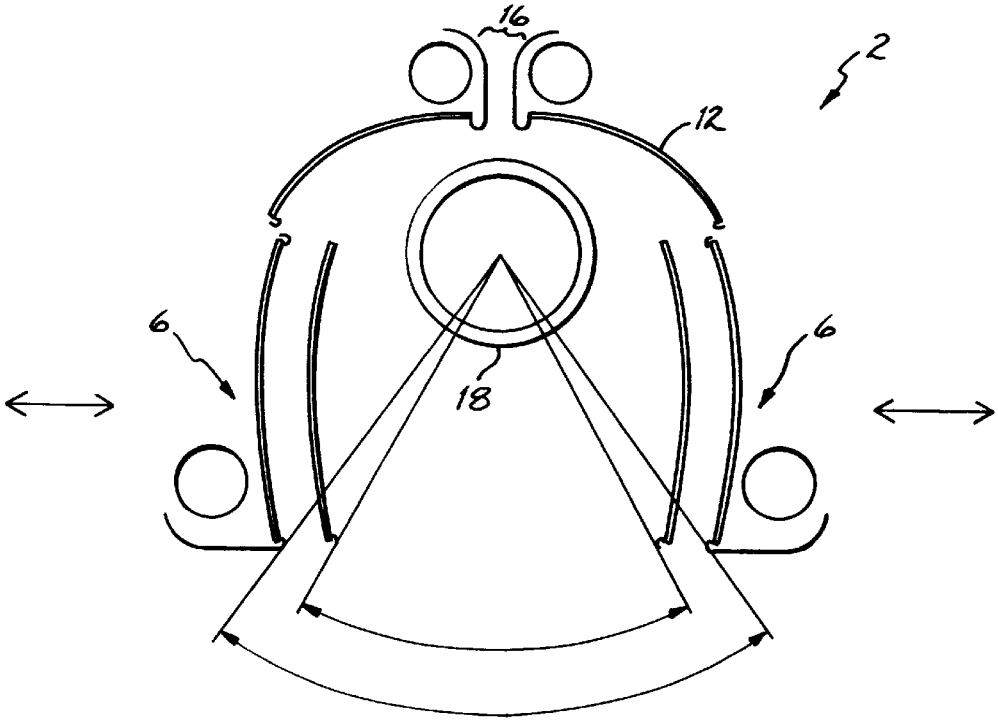
FIGS. 2A and 2B show the lamp assembly of FIG. 1 with the shutters in different positions.
Figure 2B:
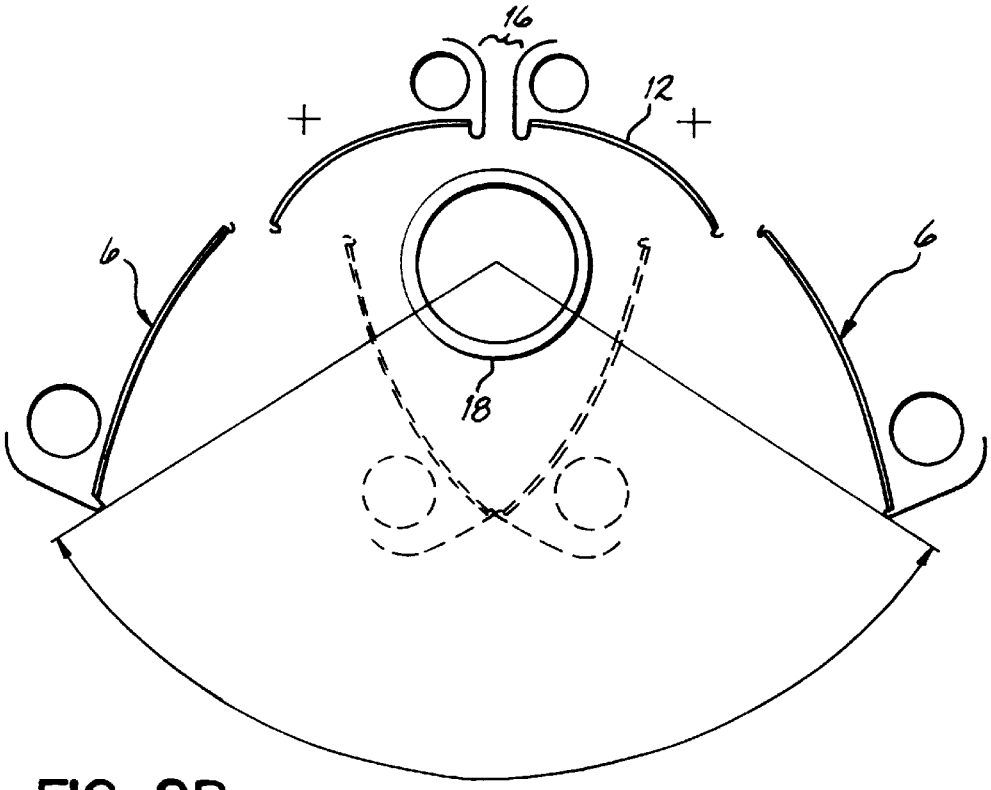
Figure 3A:
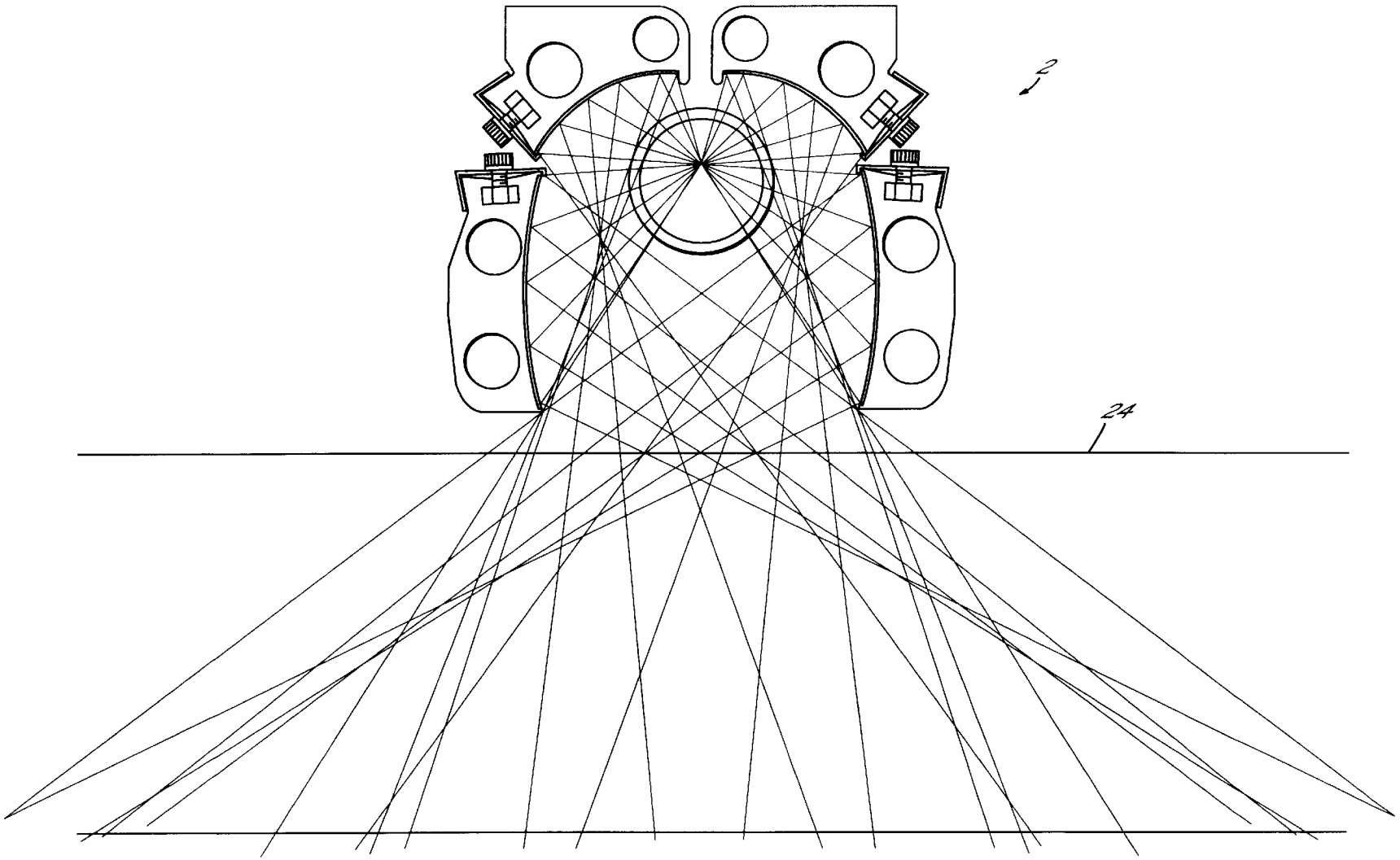
FIGS. 3A, 3B and 3C show the ray pattern produced with the shutters in the positions of FIGS. 2A and 2B.
Figure 3B:
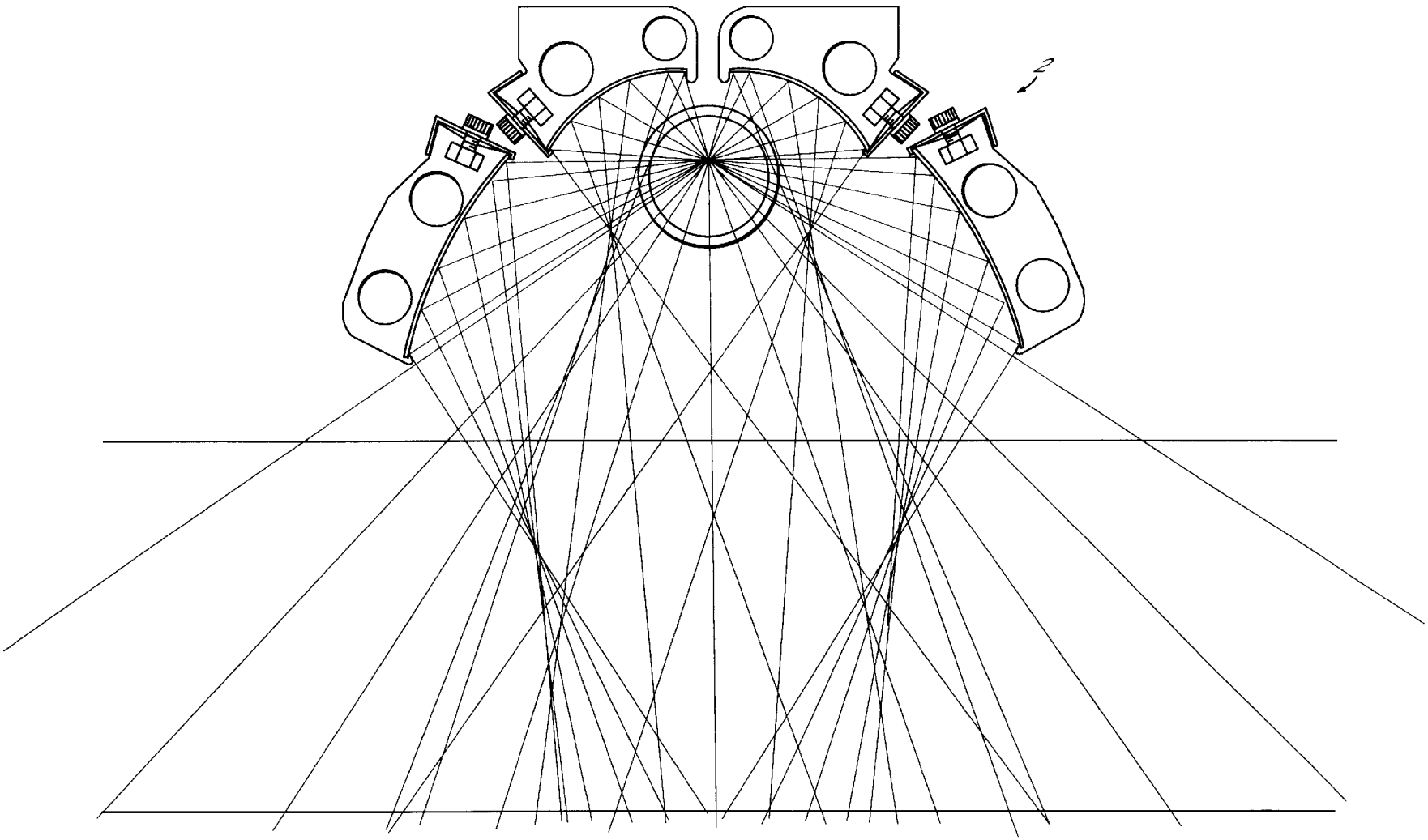
Figure 3C:
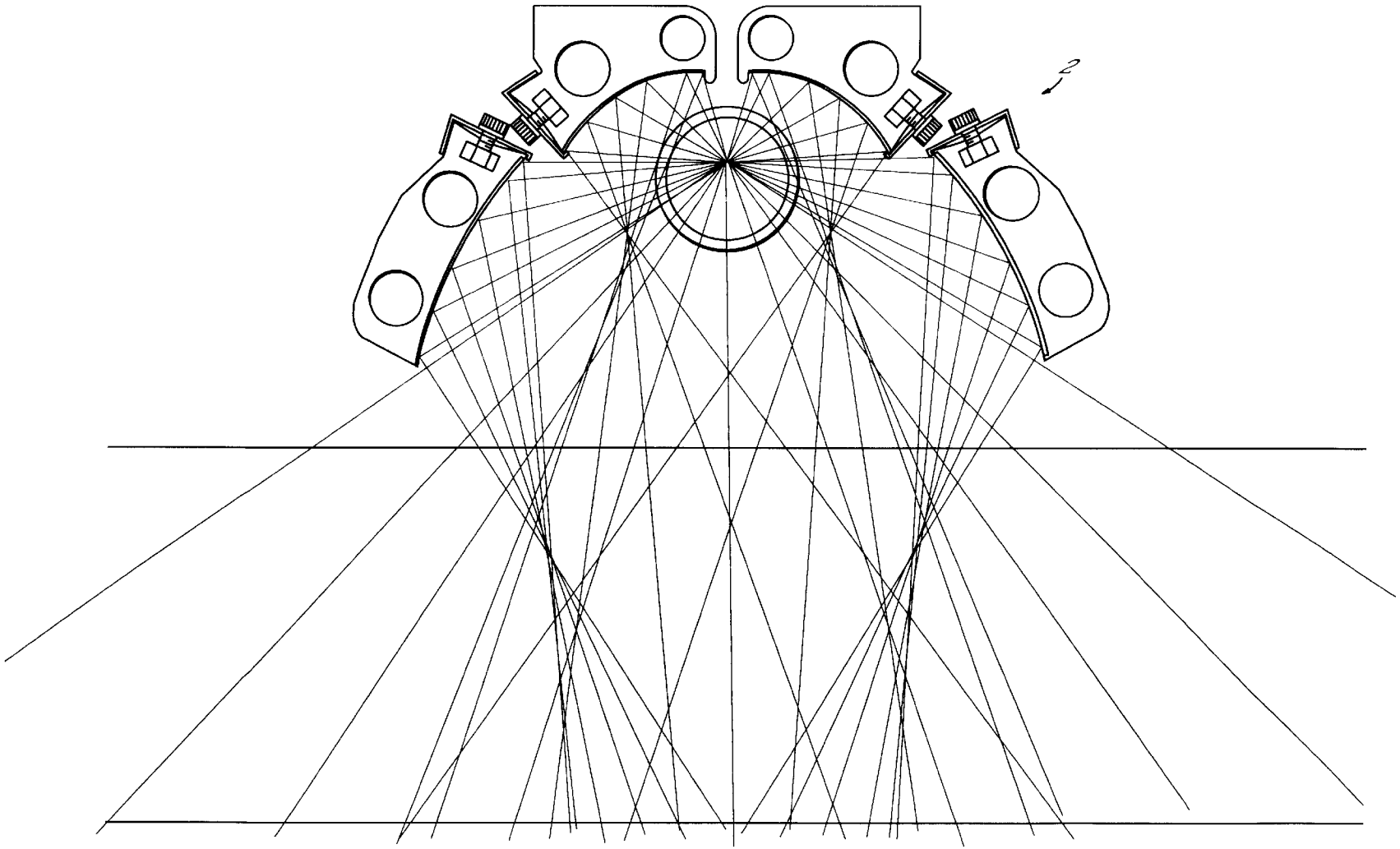

The two top elements 4 are spaced to provide an aperture 16 therebetween. Each top element 4 is also spaced from the adjacent side elements 6. The spacings allow for flow of cooling air, as illustrated in FIG. 1. The path of the cooling air flow depends on the position of the side element 6. These may be in an unshuttered position, as illustrated in FIG. 1A or a shuttered position, as illustrated in FIG. 1B. In the shuttered position the side elements 6 prevent passage of radiation from lamp 18 to a substrate passing below the reflector for a lamp 18.

The lamp assembly 2 includes air extraction means (not shown) which draws air up from below. With the side elements 6 in the unshuttered position of FIG. 1A the air flow is up between the elements 6 around the lamp 18 and out via the aperture 16. In the shuttered position of FIG. 1B the air flow is to the side of the side elements 6, between the side elements 6 and the top elements 4 and then again out through the aperture 16.

The air flow in the unshuttered position of FIG. 1A is such as to give very efficient cooling because, as is schematically illustrated by the arrows, air flows over the majority of the surface of the lamp 18.

In contrast, in the shuttered position of FIG. 1B the air cooling is much less efficient. As a consequence, the reduction in lamp temperature by the cooling air flow is less than with known arrangements. The result of this is that the stand-by power of the lamp 18 in the shuttered position can be lower since power is not required to maintain the lamp temperature at a level which will prevent the lamp from dying.

As noted above, the side elements 6 can be used for shuttering purposes. However, they can also be adjusted in the unshuttered position to vary the angle of direct radiation. This allows for changes to be made to the IR output of the lamp 18. The reason for this is that with the suitable coatings such as a dichroic coating on the reflective surfaces of the elements 4, 6, the IR output is determined by the area of the lamp 18 from which radiation directly reaches the substrate. By adjusting the reflector position, the area of the lamp 18 which produces direct radiation can be varied to in turn vary the amount of IR radiation reaching the substrate.

A further effect of adjusting the position of the side elements 6 is to vary the distance of the peak output intensity from the lamp 18. Thus, the lamp assembly 2 can be adjusted to give the most favorable conditions for curing of the coating on a substrate according to the form of the substrate and/or coating.

The variation in peak output intensity which is possible with the lamp assembly 2 is illustrated in FIGS. 4A, 4B and 4C. The regions on the substrate 24 which receive the greatest amount of radiation is changed by adjusting the position of the side elements.

The reflective surface provided by the elements 4, 6 has a generally rectangular cross-section. In comparison with known lamp assemblies having parabolic or elliptical reflective surfaces, the overall dimensions of the assembly are reduced so achieving the industry desideratum of small assembly size. The horizontal distance between the ends of the reflective surface, i.e., the distance between the lower ends of the side elements 6, is also reduced. This has the benefit of reducing the IR output for the reasons discussed above.

It has been found possible to arrange the elements 4, 6 such that there is no internal reflection and, therefore light from the lamp 18 is used more efficiently. It was unexpected that the efficiency could be so great while still allowing for an overall reduction in the size of the lamp assembly 2. Tests have shown that, in comparison to a known shuttered unfiltered lamp, the lamp power required for a given UV output intensity is reduced. Thus, the lamp assembly 2 enables cost savings in terms of reduced power requirement with the same output intensity. Alternatively, for a given power level, the intensity and therefore the speed of curing is increased and this allows substrates to be moved past the lamp at a greater rate.

Figure 4:
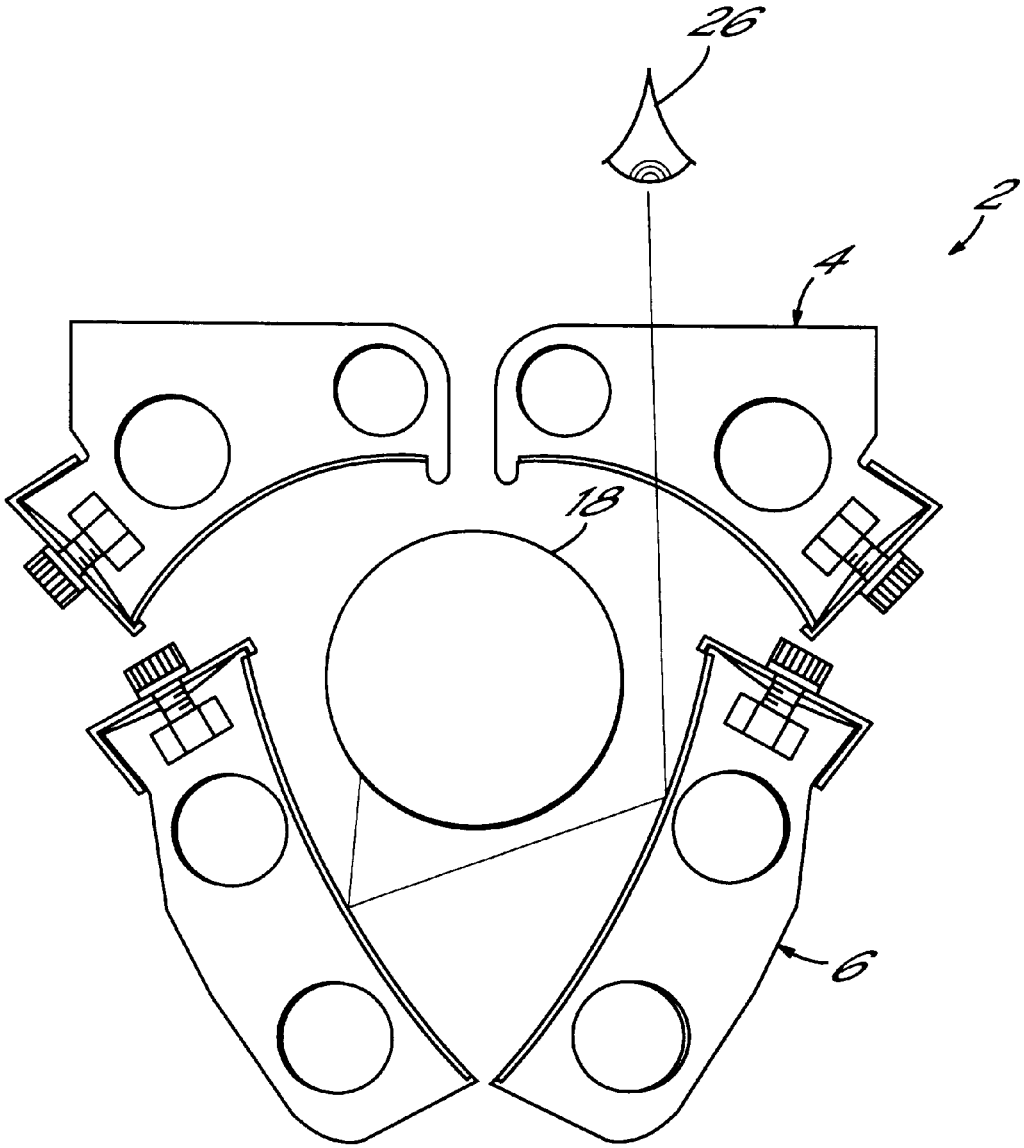
FIG. 4 shows the lamp assembly of FIG. 1 with a UV monitor.

The lamp assembly 2 may be provided with a UV monitor 26, as illustrated in FIG. 4. The UV monitor is positioned above the top elements 4 and monitors the UV radiation reflected off one of the side elements 6 via a hole formed in the top element 4. The UV monitor 26 is able to give a very accurate indication of the condition of the lamp 18 and the reflector, but does not interfere with any substrate feeding systems, such as a sheet feed system.

In tests it has been found that the reading of UV monitor 26 is reduced by approximately 40% when one of the side elements 6 is removed, approximately 42% when the lamp 18 is contaminated and over 52% when both of the side elements 6 are removed. Furthermore, the reduction is linear with increasing lamp power. These tests show that the UV monitor 26 gives an accurate indication of the overall condition of the lamp assembly and not just of the lamp 18 or the reflector.

Overall, the lamp assembly 2 provides for efficient and effective operation while still being very compact. This is achieved through the shape of the reflective surface which in turn results from the formation of the reflector which has at least three elements. By making two of the elements adjustable in position, the IR output can be varied, as too can be the locations peak output intensity.

The use of air extraction means to draw air up over the lamp rather provides efficient cooling. When combined with shutters which divert the air flow in the shuttered position, the stand-by power of the lamp can be reduced.

While the present invention has been illustrated by a description of a preferred embodiments and while these embodiments have been described in some detail, it is not the intention of the Applicants to restrict or in any way limit the scope of the appended claims to such detail. Additional advantages and modifications will readily appear to those skilled in the art. The various features of the invention may be used alone or in numerous combinations depending on the needs and preferences of the user. This has been a description of the present invention, along with the preferred methods of practicing the present invention as currently known. However, the invention itself should only be defined by the appended claims, wherein we claim:

What is claimed is:

1. A method of monitoring the condition of a lamp assembly comprising an elongate source of radiation, a reflector with an elongate reflective surface partly surrounding the source for reflecting radiation from the source down onto a substrate and curing a coating on the substrate and an aperture extending through the reflective surface, and a shutter system for shuttering the source to regulate the amount of radiation reaching the substrate, the method comprising:

shuttering the source; and measuring the level of reflected radiation exiting via the aperture in the reflective surface.

2. A method as claimed in claim 1, wherein the shutter comprises two elements positioned on either side of the source and wherein the shutter elements also form part of the reflector, the method further comprising:

measuring the level of radiation reflected from one of the shutter elements.

3. A method as claimed in claim 1 further comprising:

measuring the level of reflected radiation using a UV monitor located above and to one side of the source.

4. A lamp assembly for curing a coating on a substrate, comprising:

an elongate source of radiation;

a reflector with an elongate reflective surface partly surrounding said source for reflecting radiation from said source down onto the substrate, and an aperture extending through the reflective surface;

a shutter system for shuttering said source to regulate the amount of radiation reaching the substrate; and a monitor for measuring the level of reflected radiation exiting through said aperture in said reflective surface.

5. A lamp assembly as claimed in claim 4, wherein said monitor is a UV monitor located above and to one side of said source.

6. A lamp assembly as claimed in claim 4, wherein said shutter system comprises two side elements having lower ends and outer sides, said side elements positioned on opposite sides of said source.

7. A lamp assembly as claimed in claim 6, wherein said side elements also form part of said reflector.

8. A lamp assembly as claimed in claim 7, wherein said reflector includes two top elements spaced from each other and from said adjacent side elements.

9. A lamp assembly as claimed in claim 7, wherein said side elements are adjustable to vary at least one of the cross-section of said reflective surface and the space between said lower ends of said side elements.

10. A lamp assembly as claimed in claim 6, wherein said reflector includes an opening positioned above said source and extraction means for drawing air from above the substrate upwardly and over said source and through said reflector opening and, when said source is shuttered, the air is drawn along said outer sides of said side elements and passes to said source.

11. A lamp assembly as claimed in claim 6, wherein said side elements each comprise a body with a reflective coating.

12. A lamp assembly as claimed in claim 11, wherein said reflective coating is a dichroic coating.

13. A lamp assembly as claimed in claim 11, wherein said reflective coating is on a sheet attached to said body by at least one releasable clip.

* * * * *